US007585823B2

(12) United States Patent
Sullivan et al.

(10) Patent No.: US 7,585,823 B2
(45) Date of Patent: Sep. 8, 2009

(54) LUBRICATING FLUIDS WITH ENHANCED ENERGY EFFICIENCY AND DURABILITY

(75) Inventors: William T. Sullivan, Brick, NJ (US); Halou Oumar-Mahamat, Princeton, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 834 days.

(21) Appl. No.: 10/939,192

(22) Filed: Sep. 10, 2004

(65) Prior Publication Data

US 2005/0059563 A1 Mar. 17, 2005

Related U.S. Application Data

(60) Provisional application No. 60/502,460, filed on Sep. 13, 2003.

(51) Int. Cl.
*C10M 169/04* (2006.01)
*C10M 105/34* (2006.01)

(52) U.S. Cl. ..... 508/463; 508/400

(58) Field of Classification Search ..... 508/463, 508/400

See application file for complete search history.

(56) References Cited

U.S. PATENT DOCUMENTS

| | | | | |
|---|---|---|---|---|
| 2,757,139 | A | 7/1956 | Matuszak et al. | 252/56 |
| 3,149,178 | A | 9/1964 | Hamilton et al. | 260/683.9 |
| 3,382,291 | A | 5/1968 | Brennan | 260/683.15 |
| 3,742,082 | A | 6/1973 | Brennan | 260/683.9 |
| 3,769,363 | A | 10/1973 | Brennan | 260/283.15 |
| 3,780,128 | A | 12/1973 | Shubkin et al. | 260/683.9 |
| 3,876,720 | A | 4/1975 | Heilman et al. | 260/677 |
| 4,172,855 | A | 10/1979 | Shubkin et al. | 585/16 |
| 4,175,046 | A | 11/1979 | Coant et al. | 252/56 |
| 4,218,330 | A | 8/1980 | Shubkin | 252/46.6 |
| 4,239,930 | A | 12/1980 | Allphin et al. | 585/517 |
| 4,288,640 | A | 9/1981 | Schuster et al. | 568/855 |
| 4,367,352 | A | 1/1983 | Watts, Jr. et al. | 585/254 |
| 4,413,156 | A | 11/1983 | Watts, Jr. et al. | 585/254 |
| 4,434,308 | A | 2/1984 | Larkin et al. | 585/10 |
| 4,511,481 | A | 4/1985 | Shim | 252/32.5 |
| 4,519,932 | A | 5/1985 | Schnur et al. | 252/73 |
| 4,827,064 | A | 5/1989 | Wu | 585/10 |
| 4,827,073 | A | 5/1989 | Wu | 585/530 |
| 4,910,355 | A | 3/1990 | Shubkin et al. | 585/255 |
| 4,912,272 | A | 3/1990 | Wu | 585/10 |
| 4,914,254 | A | 4/1990 | Pelrine | 585/530 |
| 4,926,004 | A | 5/1990 | Pelrine et al. | 585/530 |
| 4,956,122 | A | 9/1990 | Watts et al. | 252/565 |
| 4,960,960 | A | 10/1990 | Harrison et al. | 568/881 |
| 4,967,032 | A | 10/1990 | Ho et al. | 585/255 |
| 5,068,487 | A | 11/1991 | Theriot | 585/510 |
| 5,093,535 | A | 3/1992 | Harrison et al. | 568/881 |
| 5,286,397 | A | 2/1994 | Schmid et al. | 252/56 S |
| 5,459,008 | A | 10/1995 | Chambers et al. | 430/126 |
| 5,817,607 | A | 10/1998 | Duncan et al. | 508/485 |
| 5,858,935 | A * | 1/1999 | Watts et al. | 508/491 |
| 6,008,167 | A | 12/1999 | Appelman et al. | 508/463 |
| 6,149,832 | A | 11/2000 | Foister | 252/62.52 |
| 6,346,504 | B1 | 2/2002 | Appelman et al. | 508/463 |
| 2003/0207775 | A1 * | 11/2003 | Sullivan et al. | 508/463 |

FOREIGN PATENT DOCUMENTS

| | | |
|---|---|---|
| CA | 2320546 | 3/2001 |
| EP | 0088453 | 9/1983 |
| EP | 0119070 | 9/1984 |
| EP | 0992570 | 4/2000 |
| JP | 1104695 | 4/1989 |
| WO | 00/58423 | 10/2000 |
| WO | 03/091369 | 11/2003 |

OTHER PUBLICATIONS

Kirk-Othmer Encyclopedia of Chemical Technology, Fourth Edition, vol. 15, p. 463-517.
Journal of Catalysis, vol. 91, 1985, p. 356-360.
Applied Catalysis, vol. 10, 1984, p. 63-76.

* cited by examiner

*Primary Examiner*—Michael A Marcheschi
*Assistant Examiner*—Frank C Campanell
(74) *Attorney, Agent, or Firm*—Nancy T. Krawczyk; Andrew B. Griffis

(57) ABSTRACT

The present invention comprises novel lubricating compositions, automotive gear lubricating compositions, and fluids useful in the preparation of finished automotive gear lubricants and finished gear oils, and methods of preparation thereof. One embodiment of the present invention comprises a lubricating composition comprising a blend of a PAO having a viscosity of greater than or equal to about 40 cSt. at 100° C. and less than or equal to about 1,000 cSt. at 100° C. and an ester having a viscosity of less than or equal to about 2.0 cSt. at 100° C., wherein said blend of said PAO and said ester has a viscosity index greater than or equal to the viscosity index of the PAO.

30 Claims, 2 Drawing Sheets

Effect of Ester Concentration on VI
Supersyn 2150 constant
Vary 2 cSt PAO

MCP 859A Blends with Supersyn 2150

MCP 164 Blends with Supersyn 2150

Effect of Ester Concentration on VI
Supersyn 2150 constant
Vary 2 cSt PAO

LUBRICATING FLUIDS WITH ENHANCED ENERGY EFFICIENCY AND DURABILITY

CROSS-REFERENCE TO RELATED APPLICATION

This application claims the benefit of U.S. Provisional Application No. 60/502,460, filed Sep. 13, 2003.

FIELD OF THE INVENTION

This invention belongs to the field of lubricating fluids and oils. More particularly, this invention relates to the use and preparation of very high viscosity index lubricating fluids and finished gear lubricants comprising a Group IV and a Group V basestock.

BACKGROUND OF THE INVENTION

Efforts to improve upon the performance of natural mineral oil based lubricants by the synthesis of oligomeric hydrocarbon fluids have been the subject of important research and development in the petroleum industry for at least fifty years and have led to the relatively recent market introduction of a number of synthetic lubricants. In terms of lubricant property improvement, the thrust of the industrial research effort on synthetic lubricants has been toward fluids exhibiting useful viscosities over a wide range of temperature, i.e., improved viscosity index, while also showing lubricity, thermal and oxidative stability and pour point equal to or better than mineral oil.

The viscosity-temperature relationship of a lubricating oil is one of the critical criteria which must be considered when selecting a lubricant for a particular application. The mineral oils commonly used as a base for single and multigraded lubricants exhibit a relatively large change in viscosity with a change in temperature. Fluids exhibiting such a relatively large change in viscosity with temperature are said to have a low viscosity index. Viscosity Index (VI) is an empirical number which indicates the rate of change in the viscosity of an oil within a given temperature range. A high VI oil, for example, will thin out at elevated temperatures slower than a low VI oil. The advantage of VI rating is that it capsulizes the effects of temperature as a single number. The viscosity index of a common paraffinic mineral oil is usually given a value of about 100. Viscosity index is determined according to ASTM Method D 2270-93 [1998] wherein the VI is related to kinematic viscosities measured at 40° C. and 100° C. using ASTM Method D 445-01. Both methods are fully incorporated by reference.

The American Petroleum Institute defines five groups of base stocks. Groups I, II and III are mineral oils classified by the amount of saturates and sulfur they contain and by their viscosity indices. Group I base stocks are solvent refined mineral oils. They contain less saturates and more sulfur and have lower viscosity indices. They define the bottom tier of lubricant performance. Group I stocks are the least expensive to produce, and they currently account for about 75 percent of all base stocks. These comprise the bulk of the "conventional" base stocks.

Groups II and III are hydroprocessed mineral oils. The Group III oils have higher viscosity indices than Group II oils do. Groups II and III stocks perform better thermal and oxidative stability. Isodewaxed oils also belong to Groups II and III. Isodewaxing rids these mineral oils of a significant portion of their waxes, which improves their cold temperature performance greatly. Groups II and III stocks account for about 20 percent of all base stocks.

| Base Oil Group | % Saturates | % Aromatics | VI | % Sulfur |
|---|---|---|---|---|
| I | <90 | >10 | <120 | >0.03 |
| II | >90 | <10 | >80, <120 | <0.03 |
| III | >90 | <10 | >120 | <0.03 |

Group II stocks may be "conventional" or "unconventional." Generally, "unconventional" base stocks are mineral oils with unusually high viscosity indices and unusually low volatilities. Low severity hydroprocessing and solvent refined Group II mineral base stocks are "conventional." Compared to Group I oils, severity hydroprocessed Group II and III oils offer lower volatility, and when properly additized, greater thermal and oxidative stability and lower pour points.

Group IV consists of polyalphaolefins. Group IV base stocks offer superior volatility, thermal stability, oxidative stability and pour point characteristics to those of the Group II and III oils with less reliance on additives. Currently, Group IV stocks, the PAOs, make up about 3 percent of the base oil market. Group V includes all other base stocks not included in Groups I, II, III and IV. Esters are Group V base stocks.

Polyalphaolefins ("PAOs") comprise a class of hydrocarbons manufactured by the catalytic oligomerization (polymerization to low-molecular-weight products) of linear α-olefins typically ranging from 1-octene to 1-dodecene, with 1-decene being a preferred material, although polymers of lower olefins such as ethylene and propylene may also be used, including copolymers of ethylene with higher olefins, as described in U.S. Pat. No. 4,956,122 and the patents referred to therein. PAO products have achieved importance in the lubricating oil market.

The PAO products typically produced may be obtained with a wide range of viscosities varying from highly mobile fluids of low-viscosity, about 2 cSt., at 100° C. to higher molecular weight, viscous materials which have viscosities exceeding 100 cSt. at 100° C. PAOs are commonly classified according to their approximate kinematic viscosity (KV) at 100° C. The kinematic viscosity of a liquid is determined by measuring the time for a volume of the liquid to flow a given distance under gravity. Dynamic viscosity can then be obtained by multiplying the measured kinematic viscosity by the density of the liquid. The units for kinematic viscosity are 1 $m^2/s$, commonly converted to cSt. or centistokes (IcSt.=$10^{-6}$ $m^2/s$) with 1 cSt. being the viscosity of water at 20° C.

PAOs may be produced by the polymerization of olefin feed in the presence of a catalyst such as $AlCl_3$, $BF_3$, or $BF_3$ complexes. Processes for the production of PAOs are disclosed, for example, in the following patents: U.S. Pat. Nos. 4,149,178; 3,382,291; 3,742,082; 3,769,363; 3,780,128; 4,172,855 and 4,956,122, which are fully incorporated by reference. PAOs are also discussed in Lubrication Fundamentals, J.G. PAO Wills, Marcel Dekker Inc., (New York, 1980). Subsequent to polymerization, the PAO lubricant range products are hydrogenated in order to reduce the residual unsaturation. In the course of this reaction, the amount of the residual unsaturation is generally reduced by greater than 90%.

Hydrocarbons generally, and in particular synthetic PAOs, have found wide acceptability and commercial success in the lubricant field for their superiority to mineral based lubricants. In terms of lubricant property improvement, industrial research efforts on synthetic lubricants have led to PAO fluids exhibiting useful viscosities over a wide range of temperature, i.e., improved viscosity index, while also showing lubricity, thermal and oxidative stability and pour point equal to or better than mineral oil. These relatively new synthetic lubricants lower mechanical friction, enhancing mechanical efficiency over the full spectrum of mechanical loads and do so over a wider range of operating conditions than mineral oil.

In accordance with customary practice in the lubricant arts, PAOs have been blended with a variety of additives such as functional chemicals, oligomers and polymers and other synthetic and mineral oil based lubricants to confer or improve upon lubricant properties necessary for applications, such as engine lubricants, hydraulic fluids, gear lubricants, etc. Blends and their additive components are described in Kirk-Othmer Encyclopedia of Chemical Technology, fourth edition, volume 15, pages 463-517, which is fully incorporated by reference.

A particular goal in the formulation of blends is the enhancement of viscosity index by the addition of VI improvers which are typically high molecular weight synthetic organic molecules. Such additives are commonly produced from polyisobutylenes, polymethacrylates and polyalkylstyrenes, and used in the molecular weight range of about 45,000 to about 1,700,000. While effective in improving viscosity index, these VI improvers have been found to be deficient because the very property of high molecular weight that makes them useful as VI improvers also confers upon the blend a vulnerability in shear stability during actual applications. Temporary shear results from the non-Newtonian viscometrics associated with solutions of high molecular weight polymers and is caused by an alignment of the polymer chains with the shear field under high shear rates with a resultant decrease in viscosity. The decreased viscosity reduces the wear protection associated with viscous oils. Newtonian fluids, in contrast, maintain their viscosity regardless of shear rate. This deficiency in shear stability dramatically reduces the range of useful applications for many VI improver additives. Accordingly, workers in the lubricant arts continue to search for better lubricant blends with high viscosity indices.

Current market conditions are extremely favorable for lubricant compositions which provide lower operating temperatures, increased operating efficiency, and increased hardware durability. With the advent of longer axle and transmission oil change intervals (ca 250,000 to 500,000 miles), durability is clearly at issue as well. Accordingly, the present invention meets these needs by allowing for the preparation of multigraded automotive gear lubricants, and lubricating fluids, which out perform prior art formulations and have none, or a greatly decreased amount of, the deficiencies found in the currently commercially available lubricants.

SUMMARY OF THE INVENTION

The present invention comprises novel lubricating compositions, automotive gear lubricating compositions and fluids useful in the preparation of finished automotive gear lubricants. The novel lubricating compositions of the present invention comprise a high viscosity PAO blended with a lower viscosity ester, wherein the final blend has a viscosity index greater than or equal to 200. In another embodiment, the novel lubricating compositions of the present invention comprise a major amount of a blend of a high viscosity PAO blended with a lower viscosity ester, wherein the final blend has a viscosity index greater than or equal to 200. The blend of the high viscosity PAO and the lower viscosity ester is generally in a major amount when present in an amount about 70% or greater by weight of the total composition, preferably about 80%, and more preferably about 90% or greater by weight of the total composition.

In another embodiment, the novel lubricating compositions of the present invention comprise finished gear oils.

In another embodiment, the present invention comprises a method of preparing lubricating compositions, having the properties discussed herein, comprising blending a high viscosity PAO with a lower viscosity ester, wherein the final blend has a viscosity index greater than or equal to 200.

In another embodiment, the novel lubricating compositions of the present invention comprise: a high viscosity PAO having a viscosity of greater than or equal to 40 cSt. at 100° C. and less than or equal to 1,000 cSt. at 100° C., blended with a lower viscosity ester having a viscosity of less than or equal to 2.0 cSt. at 100° C., wherein the final blend of said high viscosity PAO and said lower viscosity ester has a viscosity index greater than or equal to 200.

In another embodiment, the present invention comprises an automotive gear lubricating composition comprising: a high viscosity PAO having a viscosity of greater than or equal to 40 cSt. at 100° C. and less than or equal to 1,000 cSt. at 100C, blended with a lower viscosity ester having a viscosity of less than or equal to 2.0 cSt. at 100° C., wherein the final blend of said high viscosity PAO and said lower viscosity ester has a viscosity index greater than or equal to 200.

In another embodiment, the present invention comprises an automotive gear lubricating composition comprising a blend of components (A) and (B), wherein: component (A) comprises a high viscosity PAO having (i) a viscosity of greater than or equal to 40 cSt. at 100° C. and less than or equal to 1,000 cSt. at 100° C. and, (ii) a viscosity index greater than or equal to 100; and component (B) comprises a lower viscosity ester having a viscosity of less than or equal to 2.0 cSt. at 100° C.; wherein the final blend of components (A) and (B) has a viscosity index greater than or equal to 200.

In another embodiment, the present invention comprises a method of preparing a lubricating composition comprising blending a high viscosity PAO having a viscosity of greater than or equal to 40 cSt. at 100° C. and less than or equal to 1,000 cSt. at 100° C., blended with a lower viscosity ester having a viscosity of less than or equal to 2.0 cSt. at 100° C., wherein the final blend of said high viscosity PAO and said lower viscosity ester has a viscosity index greater than or equal to 200.

In another embodiment, the present invention comprises an automotive gear lubricating composition comprising: a major amount of a blend of a high viscosity PAO blended with a lower viscosity ester having a viscosity of greater than or equal to 40 cSt. at 100° C. and less than or equal to 1,000 cSt. at 100° C., said lower viscosity ester having a viscosity of less than or equal to 2.0 cSt. at 100° C., wherein the final blend of said high viscosity PAO and said lower viscosity ester has a viscosity index greater than or equal to 200.

In another embodiment, the present invention comprises an automotive gear lubricating composition comprising: a high viscosity PAO having a viscosity of greater than or equal to 100 cSt. at 100° C. and less than or equal to 300 cSt. at 100° C., blended with a lower viscosity ester having a viscosity of less than or equal to 2.0 cSt. at 100° C., wherein the final blend of said high viscosity PAO and said lower viscosity ester has a viscosity index greater than or equal to 200.

DESCRIPTION OF THE INVENTION

Figure 1:
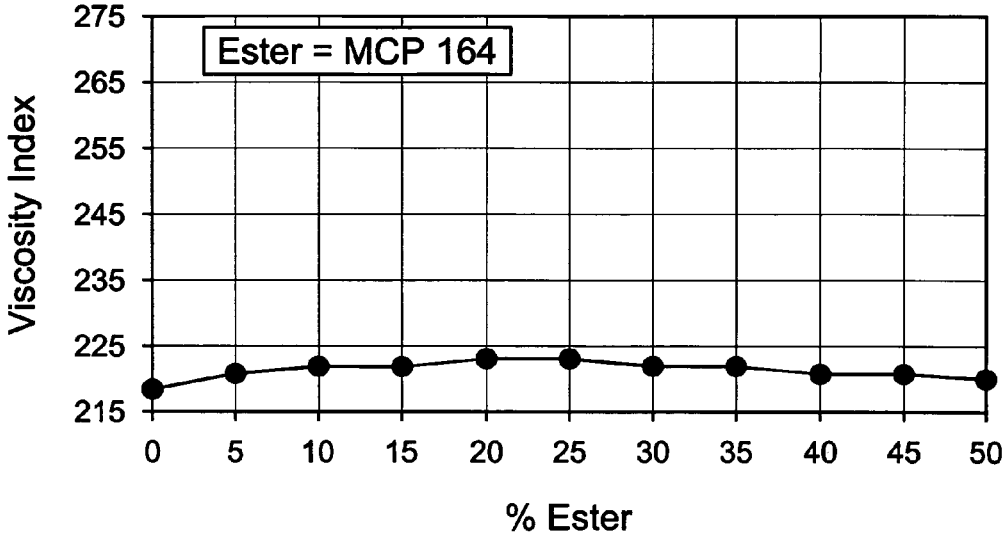
FIG. 1 presents graphically data indicating ester levels above 20 wt % offer no additional benefit for increasing viscosity index of a PAO.

The present invention comprises novel lubricating compositions useful in the preparation of finished gear lubricants and automotive gear lubricants. The novel lubricating compositions of the present invention comprise a high viscosity PAO blended with a lower viscosity ester, wherein the final blend of the high viscosity PAO and the lower viscosity ester has a viscosity index greater than or equal to 200. In another embodiment, the novel lubricating compositions of the present invention comprise a major amount of a blend of a high viscosity PAO blended with a lower viscosity ester, wherein the final blend of said high viscosity PAO and said lower viscosity ester has a viscosity index greater than or equal to 200. The blend of the high viscosity PAO and the lower viscosity ester is generally in a major amount when present in an amount about 70% or greater by weight of the total composition, preferably about 80% or greater by weight of the total composition and more preferably 90% or greater by weight of the total composition. Compositions of the present invention exhibit very high stability to permanent shear and, because of their Newtonian nature, very little, if any, temporary shear thereby maintaining the viscosity required for proper wear protection.

In another embodiment, the novel lubricating compositions of the present invention comprise: a high viscosity PAO having a viscosity of greater than or equal to 40 cSt. at 100° C. and less than or equal to 1,000 cSt. at 100° C., blended with a lower viscosity ester having a viscosity of less than or equal to 2.0 cSt. at 100° C., wherein the final blend of said high viscosity PAO and said lower viscosity ester has a viscosity index greater than or equal to 200.

In another embodiment of the novel lubricating compositions of the present invention, the high viscosity PAO has a viscosity of greater than or equal to 100 cSt. at 100° C. In another embodiment of the novel lubricating compositions of the present invention, the high viscosity PAO has a viscosity of less than or equal to 300 cSt. at 100° C. In another embodiment of the novel lubricating compositions of the present invention, the high viscosity PAO has a viscosity of greater than or equal to 100 cSt. at 100° C. and less than or equal to 300 cSt. at 100° C.

In another embodiment of the novel lubricating compositions of the present invention, the high viscosity PAO has a viscosity of greater than or equal to 100 cSt. at 100° C. In another embodiment of the novel lubricating compositions of the present invention, the high viscosity PAO has a viscosity of less than or equal to 200 cSt. at 100° C. In another embodiment of the novel lubricating compositions of the present invention, the high viscosity PAO has a viscosity of greater than or equal to 100 cSt. at 100° C. and less than or equal to 200 cSt. at 100° C.

In another embodiment of the novel lubricating compositions of the present invention, the lower viscosity ester has a viscosity of less than or equal to 2.0 cSt. at 100° C. In another embodiment of the novel lubricating compositions of the present invention, the lower viscosity ester has a viscosity of less than or equal to 1.5 cSt. at 100° C. In another embodiment of the novel lubricating compositions of the present invention, the lower viscosity ester has a viscosity of greater than or equal to 1.0 cSt. at 100° C. and less than or equal to 2.0 cSt. at 100° C.

In another embodiment of the novel lubricating compositions of the present invention, the viscosity index of the final blend of the high viscosity PAO and the lower viscosity ester is greater than or equal to 200. In another embodiment of the novel lubricating compositions of the present invention, the viscosity index of the final blend of the high viscosity PAO and the lower viscosity ester is greater than or equal to 220. In another embodiment of the novel lubricating compositions of the present invention, the viscosity index of the final blend of the high viscosity PAO and the lower viscosity ester is greater than or equal to 240. In another embodiment of the novel lubricating compositions of the present invention, the viscosity index of the final blend of the high viscosity PAO and the lower viscosity ester is greater than or equal to 260. In another embodiment of the novel lubricating compositions of the present invention, the viscosity index of the final blend of the high viscosity PAO and the lower viscosity ester is greater than or equal to 280.

In another embodiment of the novel lubricating compositions of the present invention, the high viscosity PAO and the lower viscosity ester comprise base stocks.

In another embodiment of the novel lubricating compositions of the present invention, the high viscosity PAO comprises an amount of from about 10% to about 90% by weight of the total composition. In another embodiment of the novel lubricating compositions of the present invention, the lower viscosity ester comprises 30% to about 90% by weight of the total lubricating composition. In another embodiment of the novel lubricating compositions of the present invention, the lower viscosity ester comprises 50% to about 70% by weight of the total lubricating composition. In another embodiment of the novel lubricating compositions of the present invention, the lower viscosity ester comprises 60% to about 70% by weight of the total lubricating composition.

In another embodiment, the novel lubricating compositions of the present invention further comprise one or more of: thickeners, antioxidants, inhibitor packages, and/or anti-rust additives; and/or further comprise one or more of: dispersants, detergents, friction modifiers, traction improving additives, demulsifiers, defoamants, chromophores (dyes), and/or haze inhibitors.

In another embodiment, the novel lubricating compositions of the present invention, comprise a finished gear oil. In another embodiment of the finished gear oil of the present invention, the blend of the high viscosity PAO blended with the lower viscosity ester comprises a major amount of said finished gear oil.

In another embodiment, the novel lubricating compositions of the present invention further comprise extreme pressure protection and anti-wear additives.

In another embodiment, the novel lubricating compositions of the present invention comprises an automatic transmission fluid, manual transmission fluid, transaxle lubricant, gear lubricant, open gear lubricant, enclosed gear lubricant, and/or tractor lubricant.

In another embodiment, the novel lubricating compositions of the present invention comprises a contact surface comprising at least a portion of an automatic transmission, manual transmission, transaxle, gear, open gear, enclosed gear, and/or tractor.

In another embodiment, the present invention comprises an automotive gear lubricating composition comprising: a high viscosity PAO having a viscosity of greater than or equal to 40 cSt. at 100° C. and less than or equal to 1,000 cSt. at 100° C., blended with a lower viscosity ester having a viscosity of less than or equal to 2.0 cSt. at 100° C., wherein the final blend of said high viscosity PAO and said lower viscosity ester has a viscosity index greater than or equal to 200.

In another embodiment of the novel automotive gear lubricating compositions of the present invention, the high viscosity PAO has a viscosity of greater than or equal to 100 cSt. at 100° C. In another embodiment of the novel automotive gear lubricating compositions of the present invention, the high viscosity PAO has a viscosity of less than or equal to 300 cSt. at 100° C. In another embodiment of the novel automotive gear lubricating compositions of the present invention, the high viscosity PAO has a viscosity of greater than or equal to 100 cSt. at 100° C. and less than or equal to 300 cSt. at 100° C.

In another embodiment of the novel automotive gear lubricating compositions of the present invention, the high viscosity PAO has a viscosity of greater than or equal to 100 cSt. at 100° C. In another embodiment of the novel automotive gear lubricating compositions of the present invention, the high viscosity PAO has a viscosity of less than or equal to 200 cSt. at 100° C. In another embodiment of the novel automotive gear lubricating compositions of the present invention, the high viscosity PAO has a viscosity of greater than or equal to 100 cSt. at 100° C. and less than or equal to 200 cSt. at 100° C.

In another embodiment of the novel automotive gear lubricating compositions of the present invention, the lower viscosity ester has a viscosity of less than or equal to 2.0 cSt. at 100° C. In another embodiment of the novel automotive gear lubricating compositions of the present invention, the lower viscosity ester has a viscosity of less than or equal to 1.5 cSt. at 100° C. In another embodiment of the novel automotive gear lubricating compositions of the present invention, the lower viscosity ester has a viscosity of greater than or equal to 1.5 cSt. at 100° C. and less than or equal to 2.0 cSt. at 100° C. In another embodiment of the novel automotive gear lubricating compositions of the present invention, the lower viscosity fluid has a viscosity of greater than or equal to 1.0 cSt. at 100° C. and less than or equal to 2.0 cSt. at 100° C.

In another embodiment of the novel automotive gear lubricating compositions of the present invention, the viscosity index of the final blend of the high viscosity PAO and the lower viscosity ester is greater than or equal to 200. In another embodiment of the novel automotive gear lubricating compositions of the present invention, the viscosity index of the final blend of the high viscosity PAO and the lower viscosity ester is greater than or equal to 220. In another embodiment of the novel automotive gear lubricating compositions of the present invention, the viscosity index of the final blend of the high viscosity PAO and the lower viscosity ester is greater than or equal to 240. In another embodiment of the novel automotive gear lubricating compositions of the present invention, the viscosity index of the final blend of the high viscosity PAO and the lower viscosity ester is greater than or equal to 260. In another embodiment of the novel automotive gear lubricating compositions of the present invention, the viscosity index of the final blend of the high viscosity PAO and the lower viscosity ester is greater than or equal to 280. In another embodiment of the novel automotive gear lubricating compositions of the present invention, the high viscosity PAO and the lower viscosity ester comprise base stocks.

In another embodiment of the novel automotive gear lubricating compositions of the present invention, the high viscosity PAO comprises an amount of from about 10% to about 90% by weight of the total composition. In another embodiment of the novel automotive gear lubricating compositions of the present invention, the lower viscosity fluid comprises 30% to about 90% by weight of the total composition of a synthetic hydrocarbon. In another embodiment, the novel automotive gear lubricating compositions of the present invention further comprise 50% to about 70% by weight of the total composition of an ester.

In another embodiment, the novel automotive gear lubricating compositions of the present invention further comprise one or more of: thickeners, antioxidants, inhibitor packages, and/or anti-rust additives; and/or further comprise one or more of: dispersants, detergents, friction modifiers, traction improving additives, demulsifiers, defoamants, chromophores (dyes), and/or haze inhibitors.

In another embodiment, the novel automotive gear lubricating compositions of the present invention comprise a finished gear oil. In another embodiment, of said finished gear oil of the present invention the blend of the high viscosity PAO blended with the lower viscosity ester comprises a major amount of said finished gear oil.

In another embodiment, the novel automotive gear lubricating compositions of the present invention further comprise extreme pressure protection and anti-wear additives.

In another embodiment, the novel automotive gear lubricating compositions of the present invention comprises an automatic transmission fluid, manual transmission fluid, transaxle lubricant, gear lubricant, open gear lubricant, enclosed gear lubricant, and/or tractor lubricant.

In another embodiment, the novel automotive gear lubricating compositions of the present invention comprises a contact surface comprising at least a portion of an automatic transmission, manual transmission, transaxle, gear, open gear, enclosed gear, and/or tractor.

In another embodiment, the present invention comprises an automotive gear lubricating composition comprising a blend of components (A) and (B), wherein: component (A) comprises a high viscosity PAO having (i) a viscosity of greater than or equal to 40 cSt. at 100° C. and less than or equal to 1,000 cSt. at 100° C. and, (ii) a viscosity index greater than or equal to 40; and component (B) comprises a lower viscosity ester having a viscosity of less than or equal to 2.0 cSt. at 100° C.; wherein the final blend of components (A) and (B) has a viscosity index greater than or equal to 200.

In another embodiment of the novel automotive gear lubricating compositions of the present invention, the final blend of components (A) and (B) has a viscosity index greater than or equal to 220. In another embodiment of the novel automotive gear lubricating compositions of the present invention, the final blend of components (A) and (B) has a viscosity index greater than or equal to 240. In another embodiment of the novel automotive gear lubricating compositions of the present invention, the final blend of components (A) and (B) has a viscosity index greater than or equal to 260. In another embodiment of the novel automotive gear lubricating compositions of the present invention, the final blend of components (A) and (B) has a viscosity index greater than or equal to 280.

In another embodiment of the novel automotive gear lubricating compositions of the present invention, component (A) and component (B) comprise base stocks.

In another embodiment, the novel automotive gear lubricating compositions of the present invention further comprise 30% to about 90% by weight of the total composition of an ester. In another embodiment, the novel automotive gear lubricating compositions of the present invention further comprise 50% to about 70% by weight of the total composition of an ester. In another embodiment, the novel automotive gear lubricating compositions of the present invention further comprise 60% to about 70% by weight of the total composition of an ester.

In another embodiment of the novel automotive gear lubricating compositions of the present invention, component (A) comprises a polyalphaolefin in an amount of from about 10% to about 90% by weight of the total composition.

In another embodiment, the novel automotive gear lubricating compositions of the present invention further comprise one or more of: thickeners, antioxidants, inhibitor packages, and/or anti-rust additives; and/or further comprise one or more of: dispersants, detergents, friction modifiers, traction improving additives, demulsifiers, defoamants, chromophores (dyes), and/or haze inhibitors.

In another embodiment, the novel automotive gear lubricating compositions of the present invention comprise a finished gear oil.

In another embodiment, the novel automotive gear lubricating compositions of the present invention further comprise extreme pressure protection and anti-wear additives.

In another embodiment, the novel automotive gear lubricating compositions of the present invention comprises an automatic transmission fluid, manual transmission fluid, transaxle lubricant, gear lubricant, open gear lubricant, enclosed gear lubricant, and/or tractor lubricant.

In another embodiment, the novel automotive gear lubricating compositions of the present invention comprise a contact surface comprising at least a portion of an automatic transmission, manual transmission, transaxle, gear, open gear, enclosed gear, and/or tractor.

In another embodiment, the present invention comprises a method of preparing a lubricating composition comprising blending a high viscosity PAO having a viscosity of greater than or equal to 40 cSt. at 100° C. and less than or equal to 1,000 cSt. at 100° C., with a lower viscosity ester having a viscosity of less than or equal to 2.0 cSt. at 100° C., wherein the final blend of said PAO and said ester has a viscosity index greater than or equal to 200.

In another embodiment of the method of preparing a lubricating composition of the present invention, the high viscosity PAO has a viscosity index of 100 or greater.

In another embodiment of the method of preparing a lubricating composition of the present invention, the final blend of said high viscosity PAO and said lower viscosity ester has a viscosity index greater than or equal to 220. In another embodiment of the method of preparing a lubricating composition of the present invention, the final blend of said high viscosity PAO and said lower viscosity ester has a viscosity index greater than or equal to 240. In another embodiment of the method of preparing a lubricating composition of the present invention, the final blend of said high viscosity PAO and said lower viscosity ester has a viscosity index greater than or equal to 260. In another embodiment of the method of preparing a lubricating composition of the present invention, the final blend of said high viscosity PAO and said lower viscosity ester has a viscosity index greater than or equal to 280.

In another embodiment of the method of preparing a lubricating composition of the present invention, the high viscosity PAO and the lower viscosity ester comprise base stocks.

In another embodiment of the method of preparing a lubricating composition of the present invention, the blend of the high viscosity PAO blended with the lower viscosity ester comprises a major amount of the lubricating composition.

In another embodiment, the method of preparing a lubricating composition of the present invention further comprises the step of adding 30% to about 70% by weight of the total composition of an ester. In another embodiment, the method of preparing a lubricating composition of the present invention further comprises the step of adding 50% to about 70% by weight of the total composition of an ester. In another embodiment, the method of preparing a lubricating composition of the present invention further comprises the step of adding 60% to about 70% by weight of the total composition of an ester. In another embodiment, the method of preparing a lubricating composition of the present invention further comprises the step of adding 50% by weight of the total composition of an ester.

In another embodiment, the method of preparing a lubricating composition of the present invention further comprises the step of adding one or more of: thickeners, antioxidants, inhibitor packages, and/or anti-rust additives; and/or further comprises the step of adding one or more of: dispersants, detergents, friction modifiers, traction improving additives, demulsifiers, defoamants, chromophores (dyes), and/or haze inhibitors.

In another embodiment, the method of preparing a lubricating composition of the present invention further comprises the step of adding extreme pressure protection and anti-wear additives.

In another embodiment, the product of the method of preparing a lubricating composition of the present invention comprises an automatic transmission fluid, manual transmission fluid, transaxle lubricant, gear lubricant, open gear lubricant, enclosed gear lubricant, and/or tractor lubricant.

In another embodiment, the product of the method of preparing a lubricating composition of the present invention comprises a contact surface comprising at least a portion of an automatic transmission, manual transmission, transaxle, gear, open gear, enclosed gear, and/or tractor.

In another embodiment, the present invention comprises the product of the aforementioned method of preparing a lubricating composition.

In another embodiment, the present invention comprises an automotive gear lubricating composition comprising: a major amount of a blend of a high viscosity PAO blended with a lower viscosity ester, said high viscosity PAO having a viscosity of greater than or equal to 40 cSt. at 100° C. and less than or equal to 1,000 cSt. at 100° C., said lower viscosity ester having a viscosity of less than or equal to 2.0 cSt. at 100° C., wherein the final blend of said high viscosity fluid and said lower viscosity fluid has a viscosity index greater than or equal to 200.

In another embodiment of the novel automotive gear lubricating composition of the present invention comprising a major amount of a blend of a high viscosity PAO blended with a lower viscosity ester, said high viscosity PAO and said lower viscosity ester comprise base stocks.

In another embodiment, the present invention comprises an automotive gear lubricating composition comprising: a high viscosity PAO having a viscosity of greater than or equal to 100 cSt. at 100° C. and less than or equal to 300 cSt. at 100° C., blended with a lower viscosity ester having a viscosity of less than or equal to 2.0 cSt. at 100° C. and greater than or equal to 1.5 cSt. at 100° C., wherein the final blend of said high viscosity PAO and said lower viscosity ester has a viscosity index greater than or equal to 200.

A preferred embodiment of the present invention comprises a high viscosity PAO having a viscosity of greater than or equal to 40 cSt. at 100° C. and less than or equal to 1,000 cSt. at 100° C., more preferably greater than or equal to 100 cSt. at 100° C. and less than or equal to 300 cSt. at 100° C., most preferably greater than or equal to 100 cSt. at 100° C. and less than or equal to 200 cSt. at 100° C., blended with a lower viscosity ester having a viscosity of less than or equal to 2.0 cSt. at 100° C., more preferably less than or equal to 2.0 cSt. at 100° C. and greater than or equal to 1.5 cSt. at 100° C., most preferably less than or equal to 2.0 cSt. at 100° C. and greater than or equal to 1.0 cSt. at 100° C., wherein the final blend of the high viscosity PAO and the lower viscosity ester has a viscosity index greater than or equal to 200, more preferably greater than or equal to 220, more preferably greater than or equal to 240, more preferably greater than or equal to 260, more preferably greater than or equal to 280.

In a preferred embodiment according to the present invention, the novel automotive gear lubricating compositions comprise: (i) a major amount of a blend (about 70% or greater by weight of the total composition, preferably about 90% or greater) of a high viscosity PAO having a viscosity of greater than or equal to 40 cSt., more preferably greater than or equal to 100 cSt, and more preferably greater than or equal to 150 cSt. at 100° C. and less than or equal to 1,000 cSt. at 100° C., blended with a lower viscosity ester, said lower viscosity ester having a viscosity of less than or equal to 2.0 cSt. at 100° C., wherein the final blend of the high viscosity PAO and the lower viscosity ester has a viscosity index greater than or equal to 200, more preferably greater than or equal to 220; and (ii) a minor amount of extreme pressure protection and anti-wear additives.

Fluids

High viscosity PAOs suitable for the present invention are PAOs having a viscosity of greater than or equal to 40 cSt. at 100° C. and less than or equal to 1,000 cSt. at 100° C., preferably greater than or equal to 100 cSt. at 100° C. and less than or equal to 300 cSt. at 100° C., more preferably greater than or equal to 100 cSt. at 100° C. and less than or equal to 200 cSt. at 100° C., and even more preferably greater than or equal to 150 cSt. at 100° C. and less than or equal to 200 cSt. Lower viscosity esters suitable for the present invention are esters having a viscosity of less than or equal to 2.0 cSt. at 100° C., preferably less than or equal to 1.5 cSt. at 100° C., more preferably less than or equal to 1.0 cSt. at 100° C. Examples of suitable high viscosity PAOs and lower viscosity esters are discussed hereafter.

Polyalphaolefins ("PAOs")

Polyalphaolefins suitable for the present invention high viscosity PAOs include known PAO materials, which typically comprise relatively low molecular weight hydrogenated polymers or oligomers of alphaolefins. The alphaolefins include, but are not limited to, $C_2$ to about $C_{32}$ alphaolefins with the $C_8$ to about $C_{16}$ alphaolefins, such as 1-octene, 1-decene, 1-dodecene and the like being preferred. The preferred polyalphaolefins are poly-1-octene, poly-1-decene, and poly-1-dodecene, although the dimers of higher olefins in the range of $C_{14}$ to $C_{18}$ provide low viscosity base stocks.

PAOs suitable for the present invention as high viscosity PAOs may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example, the methods disclosed by U.S. Pat. Nos. 4,149,178 or 3,382,291 may be conveniently used herein. Other descriptions of PAO synthesis are found in the following U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,308 (Larkin); U.S. Pat. No. 4,910,355 (Shubkin); U.S. Pat. No. 4,956,122 (Watts); and U.S. Pat. No. 5,068,487 (Theriot).

High viscosity PAOs suitable for the present invention may be prepared by the action of a reduced chromium catalyst with the alphaolefin, such PAOs are described in U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and, U.S. Pat. No. 4,914,254 (Pelrine). The dimers of the $C_{14}$ to $C_{18}$ olefins are described in U.S. Pat. No. 4,218,330. Commercially available high viscosity PAOs include SuperSyn™ 2150, SuperSyn™ 2300, SuperSyn™ 21000, SyperSyn™ 23000, (ExxonMobil Chemical Company).

Esters

Esters suitable for the present invention include the esters of monobasic acids with either monoalkanols or polyols. Suitable ester includes those having the formula $RCO_2R^1$, wherein R comprises an alkyl radical having from about 4 to about 10 carbon atoms and $R^1$ comprises an alkyl radical having from about 4 to about 15 carbon atoms. Preferably, $R^1$ comprises an alkyl radical having from about 4 to about 12 carbon atoms and more preferably $R^1$ comprises an alkyl radical having from about 4 to about 9 carbon atoms. Specific examples of these types of esters include isononyl 2-ethylhexanoate, isooctyl 2-ethylhexanoate, 2-ethylhexyl 2-ethylhexanoate, isononyl heptanoate, isononyl isopentanoate, isooctyl heptanoate, isononyl pentanoate, isooctyl isopentanoate, isooctyl pentanoate, octyl pentanoate, nonyl pentanoate, decyl pentanoate, octyl heptanoate, nonyl heptanoate, decyl heptanoate. Other suitable esters comprise mixtures of esters formed by the reaction of isononyl alcohol and a mixture of acids having from about 8 carbon atoms to about 10 carbon atoms or a mixed ester formed by the reaction of 2-ethylhexyl alcohol and a mixture of acids having from about 8 carbon atoms to about 10 carbon atoms. Commercially available examples include Esterex™ M31ExxonMobil Chemical Company.

Also suitable for the present invention are esters, such as those obtained by reacting one or more polyhydric alcohols, preferably the hindered polyols such as the neopentyl polyols, e.g., neopentyl glycol, with monocarboxylic acids containing from 5 to 10 carbons. The acids may be linear or branched aliphatic acids, or mixtures thereof. Other suitable esters may be obtained by reaction of the above described acids and di- or tri-ethylene glycol or di-or tri-propylene glycol alcohols capped with linear hydrocarbons having 1 to 4 carbons, preferably 3 to 4 carbons.

Extreme Pressure Protection and Anti-Wear Additives

In another embodiment, the novel lubricating compositions of the present invention further comprise extreme pressure protection and anti-wear additives. For example, mixtures of sulfur, phosphorus and/or boron-containing compounds may be included as additives, such as mixtures of Mobilad™ C-100, Mobilad™ C-175 (sulfur); Mobilad™ C-420, Mobilad™ C-421, Mobilad™ C-423 (phosphorus); and/or Mobilad™ C-200 (boron) (ExxonMobil Chemical Company). Lubricants containing these combinations have improved properties such as those relating to odor, yellow metal protection, thermal stability wear, scuffing, oxidation, surface fatigue, seal compatibility, corrosion resistance, and thermal durability. Other extreme pressure protection and anti-wear additives known in the art may also be used.

Other Components

Other components which may be included in the novel lubricating compositions of the present invention include, but are not limited to, thickeners, antioxidants, inhibitor packages and/or anti-rust additives. Additionally, other conventional additives may be included in the novel compositions of the present invention as necessary for particular service requirements, for example, dispersants, detergents, friction modifiers, traction improving additives, demulsifiers, defoamants, chromophores (dyes), and/or haze inhibitors, according to application, all of which may be blended according to conventional methods using commercially available materials.

The viscosity of the lubricating compositions of the present invention may be brought to a desired grade by the use of polymeric thickeners. Suitable thickeners that may be used in the present invention include the polyisobutylenes, as well as ethylene-propylene polymers, polymethacrylates and various diene block polymers and copolymers, polyolefins and polyalkylstyrenes. These components may be blended according to commercial market requirement, equipment builder specifications to produce products of the final desired viscosity grade.

Typical commercially available thickeners also appropriate for use in lubricating compositions of the present invention include polyisobutylenes, polymerized and co-polymerized alkyl methacrylates, and mixed esters of styrene maleic anhydride interpolymers reacted with nitrogen containing compounds, for example, the Shellvis™ products (in particular, Shellvis™ 40, Shellvis™ 50, Shellvis™ 90, Shellvis™ 200, Shellvis™ 260 and Shellvis™ 300) by Infineum International Ltd., Acryloid™ 1263 and 1265 by Rohm and Haas, Viscoplex™ 5151 and 5089 by Rohm-GmbH, and Lubrizol™ 3702 and 3715 by Lubrizol Corp.

Oxidation stability may be enhanced in the lubricating compositions of the present invention by the use of antioxidants and for this purpose, a wide range of commercially available materials is suitable. The most common types of antioxidants suitable for use in the present invention are the phenolic antioxidants, the amine type antioxidants, the alkyl aromatic sulfides, phosphorus compounds such as the phosphites and phosphonic acid esters and the sulfur-phosphorus compounds such as the dithiophosphates and other types such as the dialkyl dithiocarbamates, e.g., methylene bis(di-n-butyl) dithiocarbamate. They may be used individually by type or in combination with one another. Mixtures of different types of phenols or amines are particularly useful. Normally, the total amount of antioxidant will not exceed 10% by weight of the total composition and preferably will be less, for example below 5% by weight of the total composition. Usually, from 0.5 to 2% by weight of the total composition of an antioxidant is suitable, although for certain applications more may be used if desired.

An inhibitor package may be used to provide the desired balance of anti-wear and anti-rust/anti-corrosion properties in the lubricating compositions of the present invention. Suitable inhibitor packages include those comprising a substituted benzotriazoleamine phosphate adduct and a tri-substituted phosphate, especially a triaryl phosphate such as cresyl diphenylphosphate, a known material which is commercially available. This component is typically present in minor amounts up to 5% by weight of the composition. Normally less than 3% by weight of the total composition (e.g., from 0.5 to 2%) is adequate to provide the desired anti-wear performance.

Also suitable for use in the lubricating compositions of the present invention are inhibitor packages comprising an adduct of benzotriazole or a substituted benzotriazole with an amine phosphate adduct which also provides antiwear and antioxidation performance. Certain multifunctional adducts of this kind (with aromatic amines) are described in U.S. Pat. No. 4,511,481 to which reference is made for a description of these adducts together with the method by which they may be prepared.

Anti-rust additives suitable for use in the present invention include metal deactivators which are commercially available and typically include, for example, the N,N-disubstituted aminomethyl-1,2,4-triazoles, and the N,N-disubstituted amino methyl-benzotriazoles, the succinimide derivatives such as the higher alkyl substituted amides of dodecylene succinic acid, which are also commercially available, the higher alkyl substituted amides of dodecenyl succinic acid, such as the tetrapropenylsuccinic monoesters (commercially available), and imidazoline succinic anhydride derivatives, e.g., the imidazoline derivatives of tetrapropenyl succinic anhydride. Normally, these additional rust inhibitors will be used in relatively small amounts below 2% by weight of the total composition; although for certain applications amounts up to about 5% may be employed if necessary.

TABLE 1

Data for FIG. 1

| PAO150 Wt. % | PAO2 Wt. % | MCP164 Wt. % | KV @ 100° C. cSt | KV @ 40° C. cSt | Viscosity Index |
|---|---|---|---|---|---|
| 50 | 50 | 0 | 13.40 | 63.66 | 219 |
| 50 | 45 | 5 | 13.73 | 64.89 | 221 |
| 50 | 40 | 10 | 14.05 | 66.31 | 222 |
| 50 | 35 | 15 | 14.35 | 67.90 | 222 |
| 50 | 30 | 20 | 14.73 | 69.83 | 223 |
| 50 | 25 | 25 | 15.09 | 71.88 | 223 |
| 50 | 20 | 30 | 15.51 | 74.25 | 222 |
| 50 | 15 | 35 | 15.92 | 76.81 | 222 |
| 50 | 10 | 40 | 16.38 | 79.82 | 221 |
| 50 | 5 | 45 | 16.84 | 82.76 | 221 |
| 50 | 0 | 50 | 17.39 | 86.41 | 220 |

FIG. 1 shows the effects on viscosity index when an ester MCP164 (iso-octyl adipate) is used to replace the 2 cSt PAO in a 50:50 weight/weight mixture of a 2 cSt PAO and Super-Syn™ 2150. The 2 cSt PAO is replaced in 5 weight % increments. FIG. 1 shows that MCP 164, having a viscosity of 2.7 cSt at 100° C., has a relatively small effect on the viscosity index of the mixture.

TABLE 2

Figure 2:
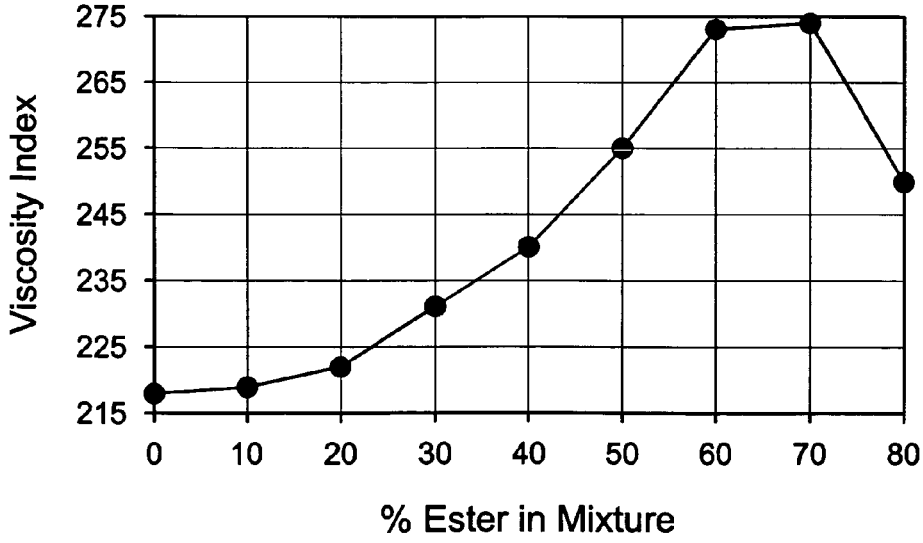
FIG. 2 presents graphically unexpected results indicating ester levels greater than 30 wt % providing significant benefit for increasing viscosity index of a PAO.

Data for FIG. 2

| PAO150 Wt. % | MCP 859A Wt. % | KV @ 100° C. cSt | KV @ 40° C. cSt | Viscosity Index |
|---|---|---|---|---|
| 100 | 0 | 143.4 | 1355.0 | 218 |
| 90 | 10 | 80.14 | 600.1 | 219 |
| 80 | 20 | 46.94 | 291.5 | 222 |
| 70 | 30 | 28.46 | 149.2 | 231 |
| 60 | 40 | 17.59 | 79.94 | 240 |
| 50 | 50 | 11.15 | 44.39 | 255 |
| 40 | 60 | 7.14 | 25.17 | 273 |
| 30 | 70 | 4.63 | 14.59 | 274 |
| 20 | 80 | 3.01 | 8.63 | 250 |
| 10 | 90 | 1.97 | 5.20 | — |

TABLE 2-continued

| Data for FIG. 2 | | | | |
|---|---|---|---|---|
| PAO150 Wt. % | MCP 859A Wt. % | KV @ 100° C. cSt | KV @ 40° C. cSt | Viscosity Index |
| 0 | 100 | 1.29 | 3.18 | — |

FIG. 2 shows the effects on viscosity index when portions of a sample of SuperSyn™ 2150 are replaced in 10% increments with the ester MCP 859A (isononyl heptanoate) which has a viscosity of 1.3 cSt at 100° C.

TABLE 3

Figure 3:
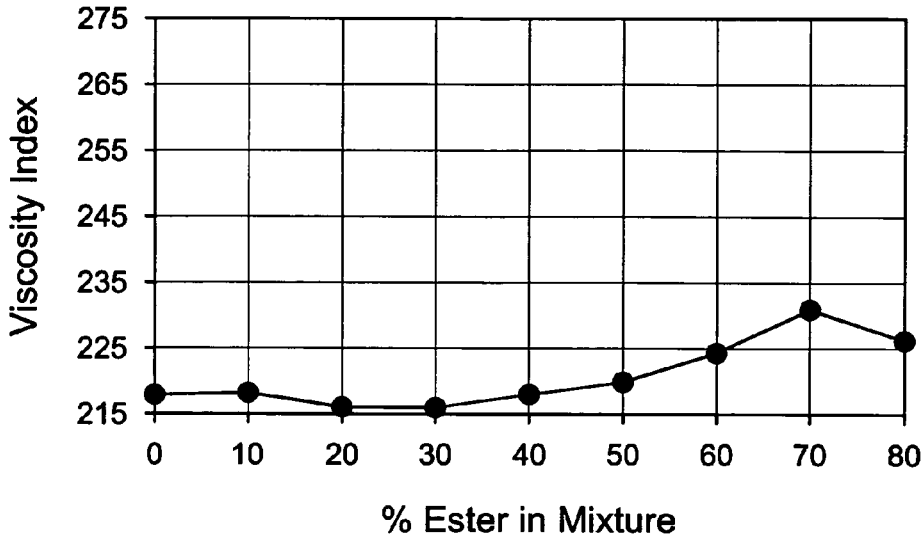
FIG. 3 presents graphically the results of mixing a dibasic ester with a viscosity of 2.7 cSt.

| Data for FIG. 3 | | | | |
|---|---|---|---|---|
| PAO150 Wt. % | MCP 164 Wt. % | KV @ 100° C. cSt | KV @ 40° C. cSt | Viscosity Index |
| 100 | 0 | 143.4 | 1355.0 | 218 |
| 90 | 10 | 97.75 | 790.3 | 218 |
| 80 | 20 | 62.60 | 439.8 | 216 |
| 70 | 30 | 41.00 | 254.6 | 216 |
| 60 | 40 | 27.19 | 151.2 | 218 |
| 50 | 50 | 18.23 | 91.66 | 220 |
| 40 | 60 | 12.35 | 56.29 | 224 |
| 30 | 70 | 8.40 | 34.89 | 231 |
| 20 | 80 | 5.75 | 21.82 | 226 |
| 10 | 90 | 3.94 | 13.83 | 197 |
| 0 | 100 | 2.7 | 9 | 149 |

FIG. 3 shows the effects on viscosity index when portions of a sample of SuperSyn™ 2150 are replaced in 10 weight % increments with the ester MCP 164 (iso-octyl adipate) which has a viscosity of 2.7 cSt at 100° C.

TABLE 4

Figure 4:
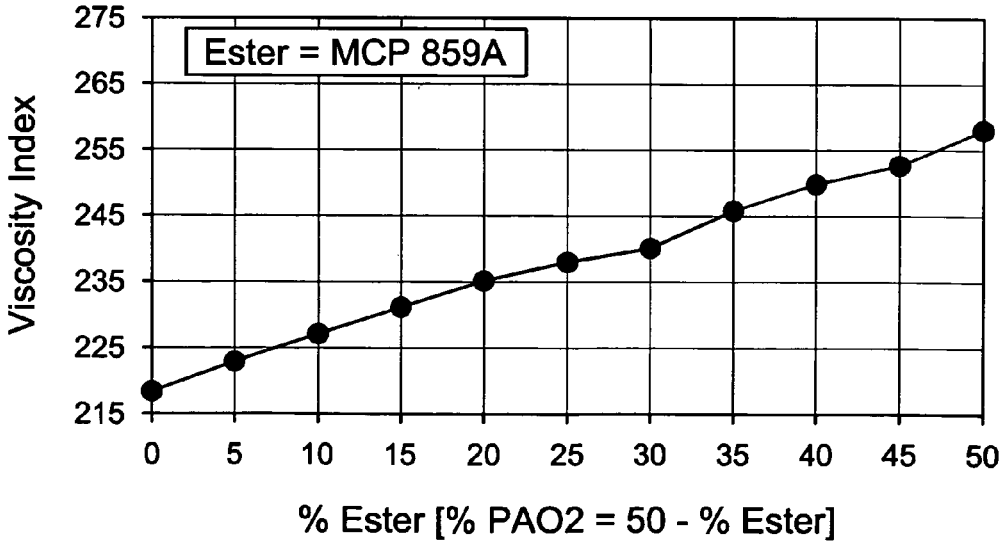
FIG. 4 presents graphically the result of replacing a 2 cSt PAO with an ester.

| Data for FIG. 4 | | | | | |
|---|---|---|---|---|---|
| PAO150 Wt. % | PAO2 Wt. % | MCP859A Wt. % | KV @ 100° C. cSt | KV @ 40° C. cSt | Viscosity Index |
| 50 | 50 | 0 | 13.40 | 63.66 | 219 |
| 50 | 45 | 5 | 13.17 | 61.01 | 223 |
| 50 | 40 | 10 | 12.90 | 58.59 | 227 |
| 50 | 35 | 15 | 12.65 | 56.31 | 231 |
| 50 | 30 | 20 | 12.41 | 54.21 | 235 |
| 50 | 25 | 25 | 12.19 | 52.41 | 238 |
| 50 | 20 | 30 | 11.97 | 50.85 | 240 |
| 50 | 15 | 35 | 11.76 | 48.84 | 246 |
| 50 | 10 | 40 | 11.57 | 47.20 | 250 |
| 50 | 5 | 45 | 11.37 | 45.75 | 253 |
| 50 | 0 | 50 | 11.18 | 44.32 | 258 |

FIG. 4 shows the effects on viscosity index when the ester MCP 859A (isononyl heptanoate), having a viscosity of 1.3 at 100° C., is used to replace the 2 cSt PAO portion of a 50:50 weight/weight mixture of a 2 cSt PAO and SuperSyn™ 2150. Comparison of the data in FIG. 1 and FIG. 4, shows that an ester with a viscosity of less than two provides unexpected increases in the viscosity index relative to the change in viscosity index when using an ester having a viscosity greater than two.

EXAMPLES

The lubricating compositions of the present invention may be prepared using standard commercial lube oil blending facilities consisting of blend tanks and/or inline mixers where heat is used only to facilitate pumping and complete mixing.

Examples A and B are comparative samples used as standards. Example C illustrates properties of embodiments of finished gear oils comprising the lubricating compositions of the present invention. The following tables, charts, and attached Figures summarize the benefits that were observed for embodiments of the present invention.

Example A is a test of a Ford Factory Fill, SAE 75W-140 fluid to determine absolute sump temperature and torque efficiency to serve as reference data. Example A had a kinematic viscosity of 25.8. For purposes of serving as a reference, the average temperature, average pinion and average dyno are, by definition, zero. These values are measured for EPA area, mid area and durability area. Relative improvements in sump temperature are indicated by negative values and relative improvement in efficiencies, for pinion or dyno, is indicated by positive values.

Example B had a kinematic viscosity of 13.5 at 100° C. and a viscosity index of 227. Example B is 6.00% MCP2119B in isononyl heptanoate, SyperSyn2150 and PAO 23. The concentration of the isononyl heptanoate was 20 wt %.

TABLE 5

| | Ave. Temp., ° F. | Ave. Pinion Efficiency, % | Ave. Dyno Efficiency, % |
|---|---|---|---|
| EPA Area | −16 | 0.1 | 0.2 |
| Mid Area | −15 | 0.2 | −0.2 |
| Durability Area | 1 | −0.1 | −0.3 |

The improvement of the sump temperature over the mild duty EPA range was about 20° F. The pinion and durability efficiencies were less than 0.3%

Example C has a kinematic viscosity of 7.9 at 100° C. and a viscosity index of 261. Example B also uses isononyl heptanoate, at a concentration of 55.7 wt %, in SuperSyn 2150. No 2 cSt PAO was used.

TABLE 6

| | Ave. Temp., ° F. | Ave. Pinion Efficiency, % | Ave. Dyno Efficiency, % |
|---|---|---|---|
| EPA Area | −40 | 2.2 | 2.6 |
| Mid Area | −31 | 0.6 | 0.5 |
| Durability Area | −2 | −0.2 | −0.1 |

Example C has an improvement in sump temperature to 40° F. in the EPA region. There is no compromise in the durability area. There is a 2.6% improvement in efficiency.

Testing

Finished gear oils comprising the lubricating compositions of the present invention possess previously unseen benefits with respect to vehicle fuel economy and hardware durability and demonstrate significantly enhanced lubricant performance. For instance, when finished gear oils comprising the lubricating compositions of the present invention are tested in truck axles, resultant oil sump temperatures are lower than with current commercially available lubricant fluids across a wide range of operating conditions. These lowered axle sump temperatures are a consequence of reduced friction within the drive train. The reduced friction leads directly to efficiency improvements. The lowered sump temperatures have the effect of enhancing hardware durability. Thus, the lubricant temperature reduction seen in the finished gear oils comprising the lubricating compositions of the present invention yields increased fuel efficiency and hardware durability.

The performance enhancements of the finished gear oils comprising the lubricating compositions of the present invention can be demonstrated using automotive drive axles on laboratory test stands where defined loads are applied to the test axles at constant axle speeds and constant cooling. The test stages are defined to include the range of actual commercial operating conditions of load and speed. Oil sump temperatures can then be measured to demonstrate indirectly the improved efficiency and hardware durability protection in the field. Alternately, the test stand can be instrumented with torque meters to estimate efficiencies more explicitly.

One such test uses a light truck axle mounted in a "T-bar" type test configuration similar to ASTM D 6121-01(the L-37 gear durability test), with the exception that in this test, the power source is from a 250 hp electric motor and constant heat removal is provided by air fans directed at the axle carrier. The axle carrier is filled with test oil and then run through stages of torques and rpms. Each stage is held until the oil sump temperature has stabilized. The temperature of each stage is recorded along with torque in and torque out readings if the axle is properly instrumented. The test then moves to the next stage until all stages are completed. Table 7 lists the torque and axle speeds that was used to generate the test data described herein.

TABLE 7

| Stage | Torque (lbf · ft.) | RPM | Comments |
|---|---|---|---|
| 1 | 50 | 2000 | A combination of torque and speed predictive of typical low load applications |
| 2 | 70 | 2000 | A combination of torque and speed predictive of typical low load applications |
| 3 | 95 | 2000 | A combination of torque and speed predictive of typical low load applications |
| 4 | 189 | 1000 | A combination of torque and speed predictive of middle load applications |
| 5 | 418 | 500 | A combination of torque and speed predictive of high load applications |
| 6 | 124 | 2700 | A combination of torque and speed predictive of middle load applications |
| 7 | 189 | 2730 | A combination of torque and speed predictive of middle load applications |
| 8 | 242 | 2730 | A combination of torque and speed predictive of middle load applications |
| 9 | 304 | 2200 | A combination of torque and speed predictive of high load applications |

TABLE 7-continued

| Stage | Torque (lbf · ft.) | RPM | Comments |
|---|---|---|---|
| 10 | 418 | 1000 | A combination of torque and speed predictive of high load applications |

Consolidating the test information from the ten stages into three groups and averaging sump temperature improvements further focuses the benefits imparted by the compositions of the present invention. Table 2 shows the stage consolidation.

TABLE 8

Consolidation of Stages into Groups

| Group ID | Discussion | Stages used |
|---|---|---|
| A | Mild test conditions typical of EPA focus for vehicle mileage documentation | 1, 2, 3 |
| B | Increased hardware stress conditions, yet still well within equipment design | 4, 6, 7, 8 |
| C | High stress conditions close to or beyond hardware design envelope | 5, 9, 10 |

In conclusion, the aforementioned examples of finished gear oils comprising the lubricating compositions of the present invention demonstrate sump temperature improvements over both the reference and other commercial fluids with little or no durability compromise.

While certain representative embodiments and details have been shown for purposes of illustrating the invention, it should be recognized that these embodiments are merely illustrative of the principles of the present invention. Since numerous modifications and changes will readily occur to those skilled in the art, the foregoing is not intended to limit the invention to the exact construction and operation shown and described, and all suitable modifications and equivalents falling within the scope of the appended claims are deemed within the present inventive concept.

The features of the present invention, together with the other objectives of the invention, and along with the various features of novelty which characterize the invention, are pointed out with particularity in the claims annexed to and forming a part of this disclosure.

TABLE 9

50/50 Ester PAO Blends Sorted in Ascending VI Order

| Ester[1] Formula and Properties | | | 50/50 PAO/Ester Blend Viscometrics | | | |
|---|---|---|---|---|---|---|
| | | | with | with | with | with |
| | KV @ 100° C. | KV @ 40° C. | Supersyn150 KV100 | PAO100 KV100 | Supersyn150 VI | PAO100 VI |
| NPG + heptanoic/iso-nonanoic acids | 2.70 | 10.00 | 13.40 | 17.49 | 205 | 173 |
| 100% PAO"s | | | 150 | 100 | 218 | 171 |
| Diisooctyl adipate | 2.70 | 9.00 | 17.39 | 16.65 | 220 | 189 |
| 2-EtHexyl palmitate | 2.70 | 8.50 | 17.36 | 15.35 | 230 | 197 |
| Isononyl 2-EtHexanoate | 1.30 | 3.50 | 11.62 | 11.26 | 235 | 199 |
| Isopentanoic acid/NPG | 1.36 | 3.64 | 12.77 | 11.25 | 236 | 198 |
| n-pentanoic acid/NPG | 1.38 | 3.66 | 12.86 | 11.36 | 237 | 198 |
| 2-EtHexyl 2- | 1.10 | 2.70 | 10.23 | 10.07 | 245 | 206 |

TABLE 9-continued

50/50 Ester PAO Blends Sorted in Ascending VI Order

| Ester[1] Formula and Properties | | | 50/50 PAO/Ester Blend Viscometrics | | | |
|---|---|---|---|---|---|---|
| | | | with | with | with | with |
| | KV @ 100° C. | KV @ 40° C. | Supersyn150 KV100 | PAO100 KV100 | Supersyn150 VI | PAO100 VI |
| EtHexanoate Isooctyl 2-EtHexanoate | 1.15 | 2.94 | 11.91 | 10.50 | 247 | 208 |
| iso-nonyl octanoate-decanoate | 1.54 | 4.08 | 13.50 | 11.85 | 248 | 212 |
| 2-ethylhexanyl octanoate-decanoate | 1.26 | 3.17 | 11.97 | 10.60 | 255 | 218 |
| isooctyl octanoate-decanoate | 1.38 | 3.47 | 12.69 | 11.12 | 256 | 220 |
| isononyl heptanoate | 1.29 | 3.18 | 11.18 | 10.77 | 258 | 220 |
| isononyl isopentanoate | 1.05 | 2.43 | 11.01 | 9.64 | 269 | 229 |
| isooctyl heptanoate | 1.15 | 2.71 | 10.88 | 9.37 | 271 | 234 |
| isononyl pentanoate | 1.06 | 2.44 | 10.75 | 9.33 | 272 | 232 |
| isooctyl isopentanoate | 0.92 | 2.00 | 9.96 | 8.67 | 281 | 241 |
| isooctyl pentanoate | 0.92 | 2.03 | 10.06 | 8.78 | 285 | 244 |

[1]Ester or acid and alcohol components of the ester are shown.

We claim:

1. A lubricating composition comprising a blend, wherein said blend consists essentially of:

a) a PAO having a viscosity of greater than or equal to about 40 cSt. at 100° C. and less than or equal to about 1,000 cSt. at 100° C.; and b) an ester having a viscosity of less than or equal to about 2.0 cSt. at 100° C.; wherein said PAO and ester blend has a viscosity index greater than or equal to about 200.

2. The lubricating composition of claim 1, wherein said PAO has a viscosity of greater than or equal to about 100 cSt. at 100° C.

3. The lubricating composition of claim 1, wherein said PAO has a viscosity of less than or equal to about 300 cSt. at 100° C.

4. The lubricating composition of claim 2, wherein said PAO has a viscosity of less than or equal to about 300 cSt. at 100° C.

5. The lubricating composition of claim 1, wherein said blend comprises greater than or equal to 80 wt % of said lubricating composition.

6. The lubricating composition of claim 1, wherein said PAO has a viscosity of less than or equal to about 200 cSt. at 100° C.

7. The lubricating composition of claim 1, wherein said ester has the formula $RCO_2R^1$, wherein R comprises an alkyl radical having from about 4 to about 9 carbon atoms and $R^1$ comprises an alkyl radical having from about 4 to about 15 carbon atoms.

8. The lubricating composition of claim 7, wherein said $R^1$ comprises an alkyl radical having from about 4 to about 12 carbon atoms.

9. The lubricating composition of claim 7, wherein said $R^1$ comprises an alkyl radical having from about 4 to about 10 carbon atoms.

10. The lubricating composition of claim 1, wherein said ester comprises at least one of isononyl 2-ethylhexanoate, isooctyl 2-ethylhexanoate, 2-ethylhexyl 2-ethylhexanoate, isononyl heptanoate, isononyl isopentanoate, isooctyl heptanoate, isononyl pentanoate, isooctyl isopentanoate, isooctyl pentanoate, octyl pentanoate, nonyl pentanoate, decyl pentanoate, octyl heptanoate, nonyl heptanoate, decyl heptanoate and mixtures thereof.

11. The lubricating composition of claim 1, wherein said ester comprises a mixture of esters formed by the reaction of isononyl alcohol and a mixture of acids having from about 8 carbon atoms to about 10 carbon atoms or a mixed ester formed by the reaction of 2-ethylhexyl alcohol and a mixture of acids having from about 8 carbon atoms to about 10 carbon atoms.

12. The lubricating composition of claim 1, wherein a ratio of said ester to said PAO ranges from about 30:70 to about 90:10.

13. The lubricating composition of claim 12, wherein said ratio ranges from about 50:50 to about 90:10.

14. The lubricating composition of claim 13, wherein said ratio ranges from about 50:50 to about 70:30.

15. The lubricating composition of claim 14, wherein the ratio is about 50:50.

16. The lubricating composition of claim 15, wherein said lubrication composition has a viscosity index at least 8% higher than said PAO in said lubricating composition.

17. The lubricating composition of claim 16, wherein said viscosity index of said lubricating composition is at least 16% greater than the viscosity index of said PAO in said lubricating composition.

18. The lubricating composition of claim 17 wherein said viscosity index of said lubricating composition is at least 28% greater than the viscosity index of said PAO in said lubricating composition.

19. The lubricating composition of claim 1, further comprising one or more of:

thickeners, antioxidants, inhibitor packages, and/or anti-rust additives.

20. The lubricating composition of claim 1, further comprising one or more of dispersants, detergents, friction modifiers, traction improving additives, demulsifiers, defoamants, chromophores (dyes), and/or haze inhibitors.

21. The lubricating composition of claim 1, wherein said lubricating composition comprises a finished gear oil.

22. The lubricating composition of claim 21, wherein the blend of said PAO blended with said ester comprises a major amount of a finished gear oil.

23. The lubricating composition of claim 1, further comprising extreme pressure protection and anti-wear additives.

24. The lubricating composition of claim 1, wherein said lubricating composition comprises a finished oil formulated for use as an automatic transmission fluid, manual transmission fluid, transaxle lubricant, gear lubricant, open gear lubricant, enclosed gear lubricant, and/or tractor lubricant.

25. A lubricating composition comprising a blend of a) a PAO having a viscosity of greater than or equal to about 40 cSt. at 100° C. and less than or equal to about 1,000 cSt. at 100° C.; and b) an ester having a viscosity of less than or equal to about 2.0 cSt. at 100° C.; wherein said PAO and ester blend has a viscosity index greater than or equal to about 220.

26. The lubricating composition of claim 25, wherein said ester has the formula $RCO_2R^1$, wherein R comprises an alkyl radical having from about 4 to about 9 carbon atoms and $R^1$ comprises an alkyl radical having from about 4 to about 15 carbon atoms.

27. The lubricating composition of claim 25, wherein a ratio of said ester to said PAO ranges from about 30:70 to about 90:10.

28. The lubricating composition of claim 25, wherein said lubrication composition has a viscosity index at least 8% higher than said PAO in said lubricating composition.

29. The lubricating composition of claim 25, further comprising one or more of:

thickeners, antioxidants, inhibitor packages, anti-rust additives, dispersants, detergents, friction modifiers, traction improving additives, demulsifiers, defoamants, chromophores, haze inhibitors, extreme pressure protection additives, and anti-wear additives.

30. The lubricating composition of claim 25, wherein said lubricating composition comprises a finished oil formulated for use as an automatic transmission fluid, manual transmission fluid, transaxle lubricant, gear lubricant, open gear lubricant, enclosed gear lubricant, and/or tractor lubricant.

* * * * *